US007544256B2

(12) United States Patent
Mayer et al.

(10) Patent No.: US 7,544,256 B2
(45) Date of Patent: Jun. 9, 2009

(54) PROCESS OF PREPARING METAL PARTS TO BE HEATED BY MEANS OF INFRARED RADIANCE

(75) Inventors: Howard Robinson Mayer, Cincinnati, OH (US); Craig A. Blue, Knoxville, TN (US)

(73) Assignees: Queen City Forging Co., Cincinnati, OH (US); The United States of America as represented by the United States Department of Energy, Washington, DC (US)

( * ) Notice: Subject to any disclaimer, the term of this patent is extended or adjusted under 35 U.S.C. 154(b) by 439 days.

(21) Appl. No.: 10/892,778

(22) Filed: Jul. 16, 2004

(65) Prior Publication Data

US 2005/0014453 A1 Jan. 20, 2005

Related U.S. Application Data

(60) Provisional application No. 60/488,004, filed on Jul. 17, 2003.

(51) Int. Cl.
*B24B 1/00* (2006.01)

(52) U.S. Cl. ..... 148/508; 148/565

(58) Field of Classification Search ..... 148/565, 148/508

See application file for complete search history.

(56) References Cited

U.S. PATENT DOCUMENTS

| | | | | |
|---|---|---|---|---|
| 3,971,674 A | | 7/1976 | Brandt et al. | 148/6.27 |
| 4,090,889 A | * | 5/1978 | George et al. | 148/516 |
| 4,111,762 A | | 9/1978 | Wade et al. | 204/33 |
| 4,282,290 A | | 8/1981 | Pellicori et al. | 428/472 |
| 4,311,623 A | | 1/1982 | Supcoe | 260/18 |
| 4,312,915 A | | 1/1982 | Fan | 428/323 |
| 5,306,359 A | | 4/1994 | Eppeland et al. | 148/511 |
| 5,336,344 A | | 8/1994 | Wei | 148/549 |

(Continued)

FOREIGN PATENT DOCUMENTS

| | | |
|---|---|---|
| DE | 10108926 | 1/2003 |

(Continued)

OTHER PUBLICATIONS

Cox, N. R., *Use of High Density IR for the Rapid Heating of Metals*, Metals Abstract, Metals Society, London, GB, vol. 22, No. 8, p. 214, XP008040448, Aug. 1989.

*Primary Examiner*—Scott Kastler
(74) *Attorney, Agent, or Firm*—Wood, Herron & Evans, LLP

(57) ABSTRACT

A method for preparing metal for heating by infrared radiance to enable uniform and consistent heating. The surface of one or more metal parts, such as aluminum or aluminum alloy parts, is treated to alter the surface finish to affect the reflectivity of the surface. The surface reflectivity is evaluated, such as by taking measurements at one or more points on the surface, to determine if a desired reflectivity has been achieved. The treating and measuring are performed until the measuring indicates that the desired reflectivity has been achieved. Once the treating has altered the surface finish to achieve the desired reflectivity, the metal part may then be exposed to infrared radiance to heat the metal part to a desired temperature, and that heating will be substantially consistent throughout by virtue of the desired reflectivity.

56 Claims, 3 Drawing Sheets

U.S. PATENT DOCUMENTS

| | | | | |
|---|---|---|---|---|
| 5,340,418 | A | 8/1994 | Wei | 148/549 |
| 5,484,985 | A | 1/1996 | Edelstein et al. | 219/772 |
| 5,981,919 | A | 11/1999 | Masten, Jr. | 219/502 |
| 6,004,894 | A | 12/1999 | Faust et al. | |
| 7,075,086 | B2 * | 7/2006 | Shelley et al. | 250/341.8 |
| 2002/0145740 | A1 * | 10/2002 | Meeks | 356/630 |
| 2003/0012978 | A1 * | 1/2003 | Sodani et al. | 148/533 |

FOREIGN PATENT DOCUMENTS

| | | |
|---|---|---|
| EP | 0541353 | 5/1993 |
| JP | 04168904 | 6/1992 |
| JP | 04190049 | 7/1992 |
| WO | WO 91/10751 | 7/1991 |

* cited by examiner

PROCESS OF PREPARING METAL PARTS TO BE HEATED BY MEANS OF INFRARED RADIANCE

CROSS REFERENCE TO RELATED APPLICATION

Pursuant to 37 C.F.R. § 1.78(a)(4), this application claims the benefit of and priority to prior filed co-pending Provisional Application Ser. No. 60/488,004, filed Jul. 17, 2003, which is expressly incorporated herein by reference.

STATEMENT REGARDING FEDERALLY SPONSORED RESERARCH OR DEVELOPMENT

The U.S. Government has a paid-up license in this invention and the right in limited circumstances to require the patent owner to license others on reasonable terms as provided for by the terms of Contract No. D.O.E. DE-PS07-01ID14026 awarded by the Department of Energy.

FIELD OF THE INVENTION

This invention relates to a method for preparing metal parts to affect and control the reflectivity of the surfaces of the parts so as to allow consistent and uniform heating of the metal parts when exposed to infrared radiance.

BACKGROUND OF THE INVENTION

In processing metal parts, the metal or alloy is typically first formed into rods, bars, billets, sheets or plates to be used as a starting material for subsequent processing. Preformed shapes produced by different production methods may also be used for raw material input to subsequent processing. The input material may then be subjected to manufacturing processes such as forging, pressing, stamping, impact forming, spinning, flow turning and/or heat treating. As a preliminary and necessary step to these manufacturing processes, the input material typically must first be heated. Convection ovens are one known method for heating the metal parts for subsequent processing. However, oven heating has disadvantages, such as high net energy input.

Recently, infrared (IR) heating has been proposed as a means for heating parts for subsequent manufacturing operations. Infrared is an "instant on" heat source that uses energy only when needed, resulting in a significantly lower net energy input than convection ovens. Improvements in the microstructure and physical properties of metal parts may also be achieved by the use of IR rapid heating. However, variations in the surface finish on the various surfaces of a metal part or between the surfaces of different metal parts in a batch process will cause the parts or the surfaces thereof to achieve different temperatures at different rates. Such temperature differences will have deleterious metallurgical affects and potentially render the products unacceptable for use.

Dip and spray coatings have been used as a means for applying material to act as a lubricant in subsequent aluminum manufacturing processes. However, these treated aluminum parts will have non-uniform coatings that are not intended to address the surface finish of the part when subsequent processing involves IR radiance as the means for heating the part. Thus, previous attempts to utilize IR heating of aluminum and other metal parts have been unsuccessful due to the lack of control of the surface finish, such as surface reflectivity. Insufficient consideration has been given to the reflection of energy from the metal surface, and the resulting variable heating rates that cause under-temperature and over-temperature conditions in the IR heated parts.

There is thus a need for a method of preparing metal parts for heating by IR radiance that addresses the importance of the surface finish of the metal parts during subsequent metal heating.

SUMMARY OF THE INVENTION

The present invention provides a method for preparing metal for heating by infrared radiance to enable uniform and consistent heating. To that end, the method of the present invention includes treating the surface of a metal part to alter the surface finish to affect the reflectivity of the surface. The surface reflectivity is evaluated at one or more points on the surface to determine if a desired reflectivity has been achieved. The treating and evaluating are performed until the evaluation indicates that the desired reflectivity has been achieved. Once the treating has altered the surface finish to achieve the desired reflectivity, the metal part may then be exposed to infrared radiance to heat the metal part to a desired temperature, and that heating will be substantially consistent throughout by virtue of the desired reflectivity. In embodiments of the present invention, a single metal part may be treated or a batch of metal parts may be treated. In further embodiments of the present invention, evaluation may be by taking measurements at a single point on a single part, at a single point of each of multiple parts, at multiple points on a single part, or at multiple points on each of multiple parts. In an exemplary embodiment of the present invention, one or more aluminum or aluminum alloy parts are treated. In another exemplary embodiment of the present invention, the orientation of the metal part or batch of metal parts are changed during the treatment so as to expose the entire surfaces thereof to the surface treatment. Alternatively, the treatment medium may be reoriented during the treatment so as to expose all surfaces to the treatment. Similarly, the orientation of one or more metal parts may be changed during measuring to accommodate measurements from differing surface points, or the measuring devices may be reoriented during the measuring to achieve the same affect.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
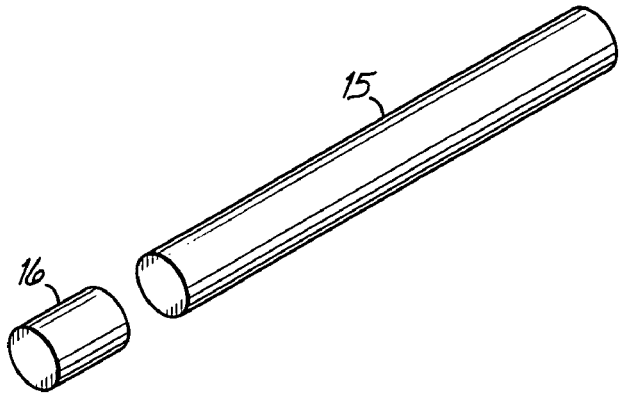
FIG. 1 is a perspective view of a metal part to be treated by the method of the present invention.

The present invention provides a method for preparing metal parts for subsequent heat treatment by infrared (IR) radiance to provide consistent and reliable heating of the parts. To that end, the surface of one or more metal parts is treated to alter the surface finish to affect the reflectivity of the surface, and the reflectivity is evaluated, for example measured, at one or more points to determine if a desired reflectivity has been achieved. The treatment of the surface may be repeated as many times as necessary until the measurements or other evaluation indicate that the desired reflectivity is achieved. The metal part(s) may then be exposed to IR radiance as a means of heating the part(s). The heating will be uniform by virtue of the desired reflectivity having been achieved and verified. The present invention recognizes that control of the reflectivity of the surface of metal parts is necessary for subsequent infrared heating of the metal parts. Depending on the surface reflectivity, IR radiation may be absorbed or reflected from the surface, and may be absorbed or reflected at different intensities. Therefore, the present invention recognizes that an inconsistent surface finish on a single metal part or an inconsistent surface finish from one part to another within a batch of metal parts may cause variations in the rate and/or extent of heating within each metal part or among the different parts in a batch. Thus, not only must the surface of the metal part be treated to affect a change in the surface reflectivity, but the surface reflectivity must be measured or otherwise evaluated to determine if a desired surface reflectivity has been achieved so as to provide subsequent consistent and reliable IR heating. The method of the present invention may be utilized any time IR heating is deemed to be desirable as a preliminary and necessary step to a subsequent manufacturing process, such as forging, pressing, stamping, impact forming, spinning, flow turning or heat treatment. The surface conditions created by the method of the present invention are uniform and consistent, and are not removed or significantly altered by typical handling processes.

The method of the present invention may be applied to any metal part or surface where reflectivity must be controlled for subsequent heating utilizing IR radiation. The term "metal" is understood to refer to any metallic part, whether it be pure metal or a metal alloy. The present invention may find particular applicability in the treatment of aluminum parts. For example, the method of the present invention may be applied to all aluminum alloy systems, including the wrought alloy systems, the cast alloy systems, and other grades and alloys where aluminum is the primary alloying element. The wrought aluminum alloy systems are generally designated as 1XXX, 2XXX, 3XXX, 4XXX, 5XXX, 6XXX, 7XXX, 8XXX and 9XXX, in accordance with the Aluminum Association (AA) classification system. The cast aluminum alloy systems are generally designated as 1XX.X, 2XX.X, 3XX.X, 4XX.X, 5XX.X, 6XX.X, 7XX.X, 8XX.X and 9XX.X, in accordance with the AA classification system. By way of further example and not limitation, the method of the present invention may also be applied to titanium, titanium alloy systems, copper, copper alloy systems, and other titanium and copper grades and alloys where titanium or copper is the primary alloying element.

The metal parts to be treated by the method of the present invention may be in any desired starting form, for example, rod, bar, billet, sheet, plate, or preformed shapes. Alternatively, the starting material may be the product of pressing, forming, forging, casting, or powder or liquid metal molding, or the products of other methods of producing shape-specific metal parts. Non-uniform shapes may be especially suited for heating with IR radiance, and thus may be especially suited for treatment by the present invention.

The method of the present invention will be further described with reference to the schematic depictions of FIGS. 1-7, wherein like reference numerals are used to refer to like parts. FIG. 1 depicts a metal part 16 in the form of a rod cut to length from an extruded bar 15. The rods 16 may be typical input material for the method of the present invention. The metal part 16 is surface treated in accordance with the present invention to alter the surface finish to affect the reflectivity of the surface. An exemplary treating method is abrasive blasting of the surface of the metal part. For example, the treatment of the surface may include shot blasting, grit blasting, sand blasting, glass bead blasting or wet blasting. The abrasive media may be metallic or non-metallic and may be combined with any fluid, such as water, air or gas, and accelerated toward the metal part in a pressurized fluid stream.

Figure 2:
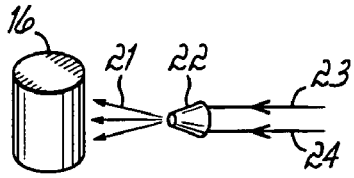
FIG. 2 schematically depicts, in perspective view, one embodiment for treating a metal part to alter its surface finish in accordance with the present invention.

Referring to FIG. 2, abrasive media 23 is combined with a pressurized gas flow 24 and fed into a nozzle 22. An abrasive media-containing gas stream 21 exits the nozzle 22 to impact the surface of a metal rod 16. In one embodiment of the present invention, the orientation of the rod 16 may be changed relative to the gas stream 21 during the treatment to allow additional surfaces to be impacted, and even to allow all surfaces of the metal rod 16 to be sufficiently impacted so as to alter the entire surface finish thereof. In another embodiment of the present invention, the orientation of nozzle 22 is changed during the treatment to likewise provide treatment of additional or all surfaces of the metal rod 16.

Figure 3:
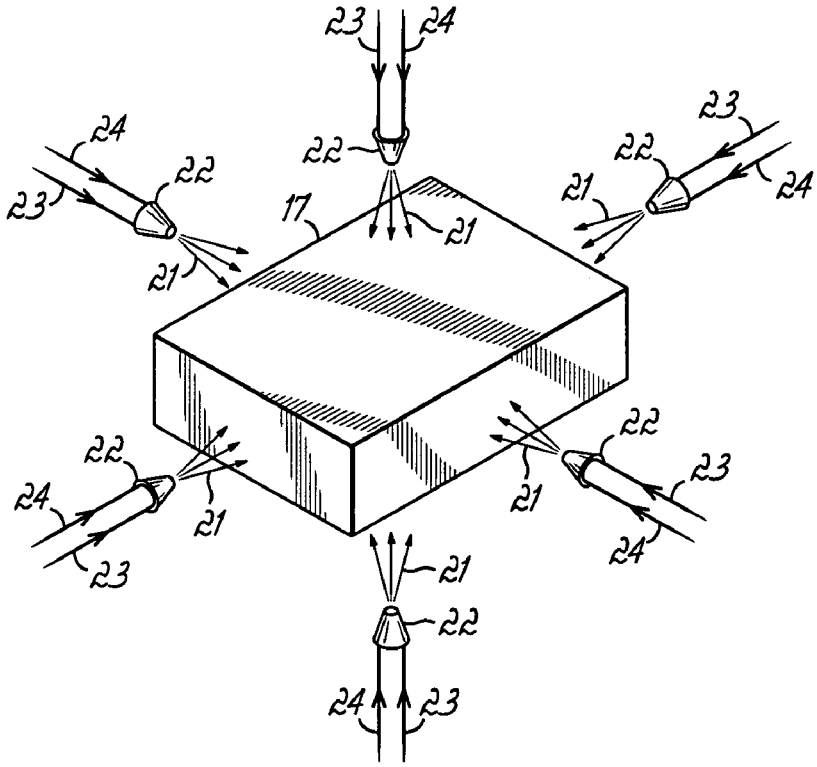
FIG. 3 schematically depicts, in perspective view, an alternative embodiment for treating a metal part in accordance with the present invention.

FIG. 3 schematically depicts a metal part 17 in the form of a billet being treated by abrasive blasting from an array of nozzles 22 oriented around the metal part 17 to achieve impact of additional surfaces, and even all the surfaces by the abrasive media-containing gas stream 21 without the need to change the orientation of the metal part 17 or the nozzles 22.

Figure 4:
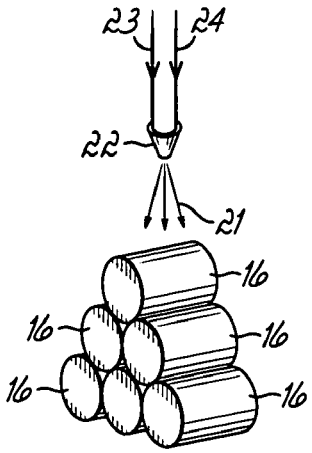
FIG. 4 schematically depicts, in perspective view, yet another embodiment for treating a batch of metal parts in accordance with the present invention.

FIG. 4 schematically depicts a plurality of metal parts 16, also referred to as a batch, being treated in accordance with the present invention. Thus, the present invention is applicable to both single-part processing and batch processing. In a batch process, a single nozzle or an array of nozzles may be used, as described above with reference to single-part processing, and the orientation of the batch of metal parts may be changed relative to the nozzle or nozzles during the treatment to ensure impact of additional or all the surfaces in the batch, or the orientation of the nozzle or nozzles may be changed during the treatment for the same purpose. It may be understood that, although FIG. 4 depicts the parts neatly arranged, the parts may exist in a random and even haphazard manner in the batch.

In addition to abrasive blasting, as depicted in FIGS. 1-4, treatment of the surface may also be affected by contacting the surfaces of the metal parts with an abrasive coated product, such as a grinding wheel, a wire wheel, a wire brush, a sanding belt, or other friable materials known in the art that are intended for surface grinding or polishing and that are capable of altering or controlling the surface finish and reflectivity to achieve the desired reflectivity for uniform heating by IR radiation. Alternatively, coatings may be used where such coatings are capable of achieving the desired reflectivity. For example, coatings of dry powder or liquid colloids may be used. There are commercial coating products currently available that are designed for lubrication or protection from oxidation, but none of these coatings are targeted specifically at enhancing or controlling the IR energy. However, it is anticipated that such materials can and will be developed, in which case, such coatings may be applicable as a treatment method in the present invention. Such coatings may include electrostatic powder coating, the use of volatilized liquid materials, and thermal spray materials. A dry powder coating may be applied by tumbling the metal parts in a powder and then heating the parts to fuse the powder to the metal part and/or to fuse the particles to each other to form a shell around the metal part. Liquid colloids are typically applied by dipping or spraying the metal part with the coating material, and the part may be heated before or after the coating process to set the coating and drive off the liquid carrier.

After treating the surface of the metal part(s), the reflectivity of the surface is evaluated to determine if the desired reflectivity has been achieved. In an exemplary embodiment, the evaluation is by means of measuring the surface reflectivity with an appropriate measuring device. The treating and measuring are performed until the measuring indicates that that desired reflectivity has been achieved. The surface treatment and the measurements of the surface reflectivity may only need to be performed once if the first measurements indicate that the first treatment was sufficient to achieve the desired reflectivity. Alternatively, the surface treatment and measurements may be repeated as many times as necessary to achieve the desired reflectivity. It may be appreciated that most surface treatment techniques are destructive in nature, rendering measurement of the surface reflectivity during the treating to be impractical, if not impossible. Thus, the method of the present invention contemplates performing the surface treatment and then stopping the treatment to perform the measurements, and then repeating these two sequential steps, if necessary, and as many times as necessary until the measurements indicate that the desired surface reflectivity has been achieved. In batch processing, it may be appreciated that the measurements may be performed on the entire batch, or on a sample of metal parts taken from the batch, which sampling is expected to be indicative of the surface finish for the entire batch. The present invention further contemplates that measurement devices may now or hereafter exist that are capable of taking in situ measurements of the surface reflectivity during treatment, such that the treating and measuring may occur concurrently, and the treating is stopped when the concurrent measurements indicate that the treatment has achieved the desired reflectivity.

In another embodiment of the present invention, the surface reflectivity is evaluated by other means, such as visual inspection of the surface finish. The present invention contemplates that there are persons skilled in the art of metal surface finishing that possess the ability to visually compare the surface of a treated part to the surface of a known acceptable part (a standard part) and accurately assess whether the desired reflectivity has been achieved. Thus, the method of the present invention is not limited to physical measurement techniques for evaluating the surface reflectivity.

Figure 5:
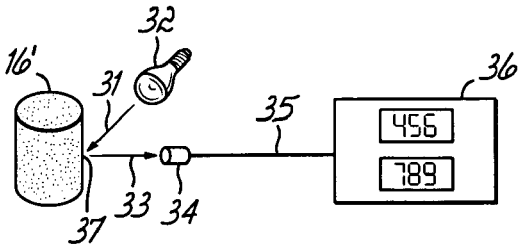
FIG. 5 schematically depicts, in perspective view, one embodiment for measuring the surface reflectivity of a treated part in accordance with the present invention.

FIG. 5 schematically depicts one embodiment of the present invention for measuring the reflectivity of the surface of a treated metal part, such as a rod 16 after the treatment depicted in FIG. 2. A device 32 that emits electromagnetic radiation 31 is positioned to illuminate a treated metal part 16' at a point 37 on the surface thereof. The intensity of the radiation is sufficient such that reflected radiation 33 may be received by an electronic detection device 34. The detection device 34 produces an electric signal proportional to the radiation detected and transmits it via wires 35 to an electronic metering device 36 which displays the value of the surface reflectivity. The surface reflectivity value is then interpreted to determine if the surface reflectivity is at the desired value. In one embodiment of the present invention, the orientation of the treated metal part 16' is changed in relation to the emitting device 32 and the detection device 34 during the measuring to allow reflected radiation 33 from several different points 37 on the surface of the treated metal part 16' to be detected. These different measurement values may then be interpreted to determine the uniformity of the surface finish.

In one embodiment of the present invention, the measuring includes taking measurements from a plurality of points 37 on the surface of the treated metal part 16' and the values are compared to determine if the surface reflectivity is substantially uniform among the plurality of points 37. For example, the desired surface reflectivity may be achieved when all measurements indicate that the surface reflectivity is within +/−5% of a specified surface finish ideal for IR heating for the particular part being treated. It may be understood that the desired surface reflectivity may vary depending on the type of metal or metal alloy system, the number of parts, the shape of the parts, etc. In another embodiment, the measuring may be at a single point 37 that is on a surface of the metal part 16 that is particularly difficult to treat, such that when a measurement taken at that point 37 indicates that a desired reflectivity has been achieved, it may be assumed that the surface finish has a desired reflectivity on the remainder of the surfaces that are not difficult to treat. In other words, the metal part may have a surface that is oriented so to present a difficulty of alteration of the finish thereof that represents a maximum difficulty of alteration for the part. The measuring may then include a point on that surface, and the desired reflectivity is achieved when the measurement indicates that a minimum threshold reflectivity has been reached on that surface. It may be appreciated that in some instances, once a threshold value has been reached, additional surface treatment may have no further affect on the reflectivity and consequently on the uniformity of the IR heating. Thus, measuring at a point on the surface that is likely to be the last place that the threshold reflectivity will be achieved may be indicative of the desired reflectivity for the entire surface of the part.

Figure 6:
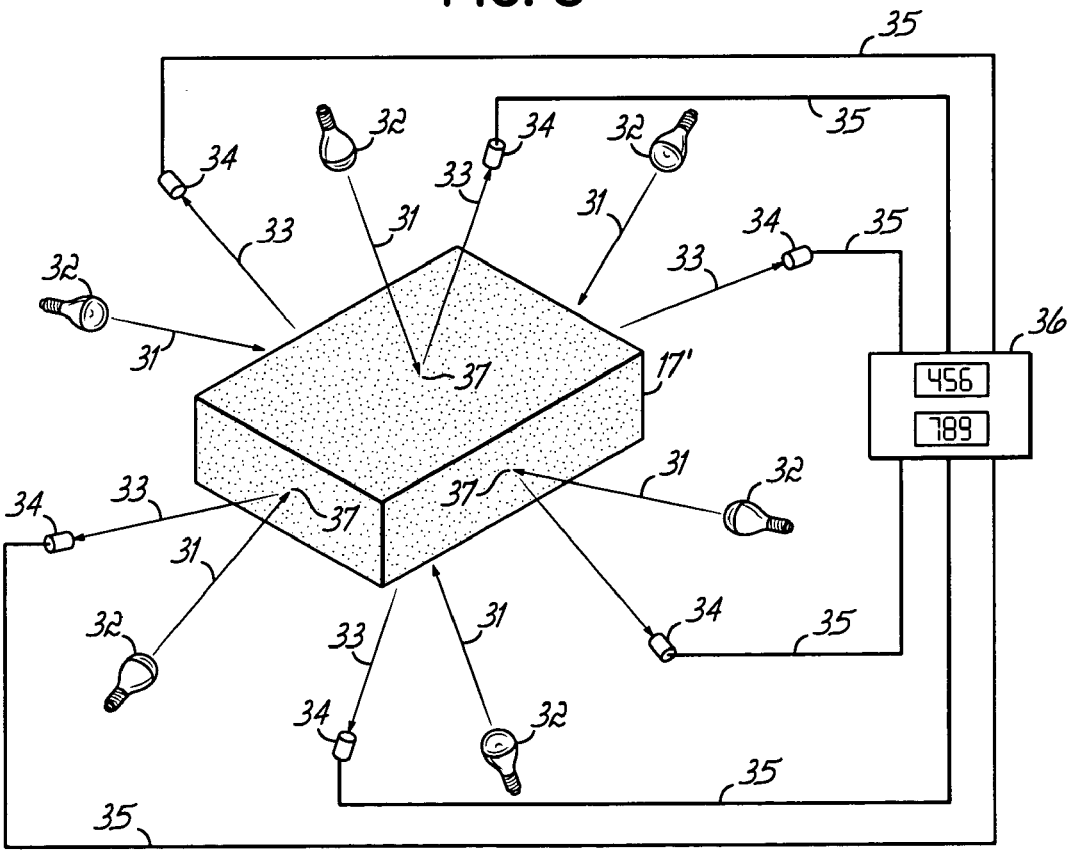
FIG. 6 schematically depicts, in perspective view, an alternative embodiment for measuring the surface reflectivity of a treated metal part in accordance with the present invention.

In an alternative embodiment of the present invention depicted in FIG. 6, an array of emitting devices 32 and detection devices 34 may be positioned around the treated metal part 17', shown as a treated billet, such as the billet 17 after the treatment depicted in FIG. 3, so as to measure the surface reflectivity from a plurality of points 37 on the various surfaces of the treated metal part 17'. By using an array of measuring devices, it may be unnecessary to change the orientation of the metal part or the measurement devices during the measuring. In FIG. 6, the signals transmitted by detection devices 34 are shown being fed to a single electronic metering device 36. However, it may be appreciated that the signals may be fed to multiple metering devices 36. The surface reflectivity values from the array of detection devices 34 are then interpreted to determine if the desired surface reflectivity has been achieved. If not, then the surface treatment is repeated and the measurements are taken again. The treatment and measuring may be repeated as many times as necessary until the desired surface reflectivity is achieved.

Figure 7:
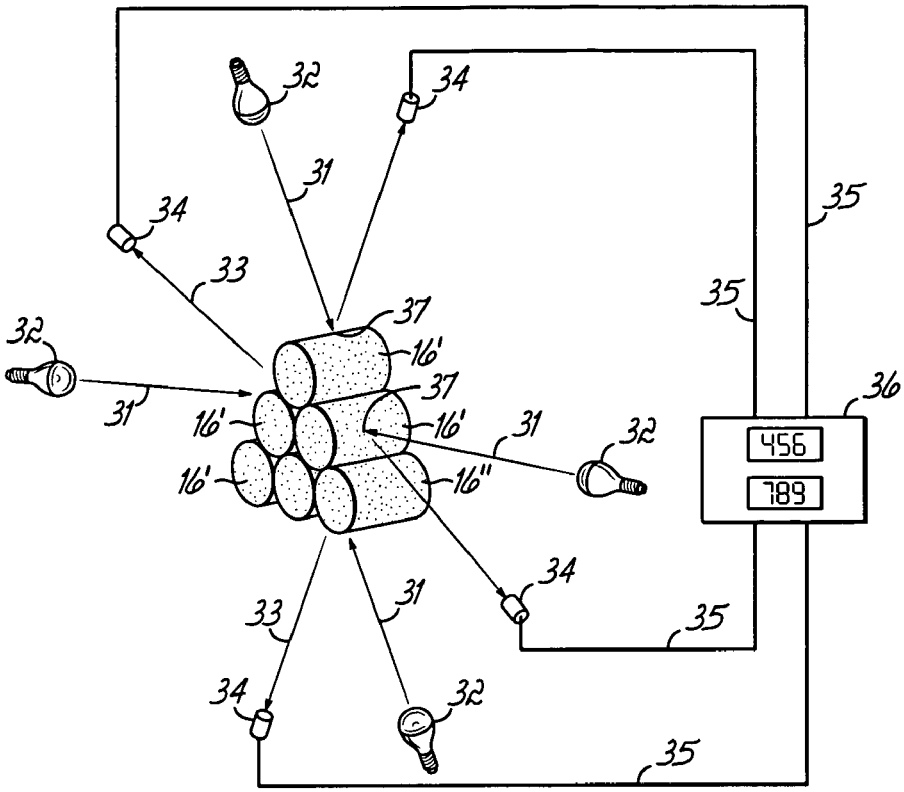
FIG. 7 schematically depicts, in perspective view, yet another embodiment for measuring the surface reflectivity in a batch of treated metal parts in accordance with the present invention.

In yet another alternative embodiment of the present invention depicted in FIG. 7, an array of emitting devices 32 and detection devices 34 may be positioned around a batch of treated metal parts 16', such as the batch of parts 16 after the treatment depicted in FIG. 4. The surface reflectivity measurements are taken from a plurality of points 37 residing on surfaces of different treated metal parts 17' in the batch. These values from the surfaces of the various parts may then be compared to determine if the surface reflectivity is uniform from one part to another within the batch. If not, the batch of treated metal parts 16' may be returned for further surface treatment as many times as necessary until uniformity of surface reflectivity is achieved throughout the batch to ensure that the batch may be uniformly heated by IR radiance during subsequent processing.

It may be appreciated that the orientation of the emitting devices 32 and detection devices 34 as well as the energy intensity for the emitting devices 32 will vary based upon the geometry of the part being measured and the sensitivity of the detector being used. By way of example and not limitation, the emitting devices may be positioned approximately 10-100 mm away from the surface of the part. In a further example, a high intensity visible wavelength emitter (a bright light) may be directed through a fiber optic conductor to a focusing device positioned 25 mm from the surface to be measured and positioned such that the radiation emitted will be reflected at an angle matched by a photodetector receiver similarly positioned to receive the reflected radiation.

Figure 8:
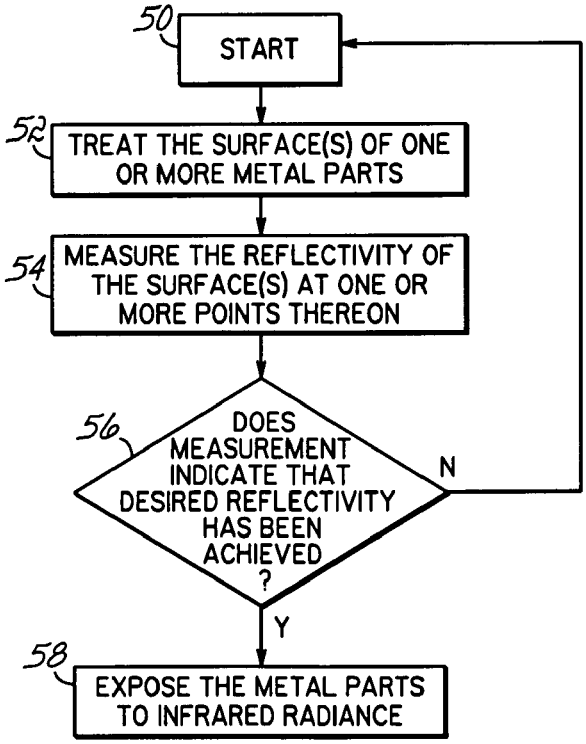
FIG. 8 is a flow chart of one embodiment of the method of the present invention.

One embodiment of the method of the present invention will be further described with reference to the flow chart in FIG. 8. At 50, the process is started, and at 52 the surface(s) of one or more metal parts are treated. At 54, the surface reflectivity of the surface(s) is measured. At 56, the measured values of the surface reflectivity are compared to a desired reflectivity to determine if the desired reflectivity has been achieved. If the answer to the query is no, the process is started over again at 50 and the metal parts are treated again at 52 and the reflectivity is measured again at 54. If the query is yes, then the metal parts are exposed at 58 to infrared radiance. The exposure at 58 will heat the parts in a uniform manner by virtue of achieving the desired reflectivity by the surface treatment at 52. The uniform heating of the metal parts by virtue of the method of the present invention will provide positive results during subsequent manufacturing processes and reduce the number of products that are considered unacceptable for use.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A method of preparing and heating a metal part by infrared radiance, the method comprising:

treating the surface of a metal part to alter the surface finish to affect the reflectivity of the surface;

physically measuring the reflectivity of the surface at one or more points on the metal part, the treating and measuring being performed until the measuring indicates that a desired reflectivity is achieved; and after the measuring indicates that the desired reflectivity is achieved, and without further treatment of the surface of the part, exposing the metal part having the achieved desired reflectivity to infrared radiance to heat the metal part to a desired temperature.

2. The method of claim 1 wherein the measuring is at a plurality of points and the treating and measuring are performed until the measuring indicates that the desired reflectivity is achieved at each of the plurality of points.

3. The method of claim 1 wherein the metal part includes a threshold surface oriented to present a difficulty of alteration of the finish thereof that represents a maximum difficulty of alteration for the part, wherein the measuring includes a point on the threshold surface, and wherein the desired reflectivity is a minimum threshold reflectivity.

4. The method of claim 1 wherein the treating comprises treating the surfaces of a batch of two or more metal parts concurrently, the measuring is at a plurality of points taken from the surfaces of a plurality of metal parts in the batch, and the treating and measuring are performed until the measuring indicates that the desired reflectivity is achieved at each of the plurality of points from the batch of metal parts.

5. The method of claim 1 wherein the metal part comprises aluminum or an aluminum alloy.

6. The method of claim 1 wherein the metal part comprises an aluminum alloy where aluminum is the primary alloying element.

7. The method of claim 1 wherein the treating includes blasting the surface with an abrasive medium.

8. The method of claim 7 further comprising, while blasting the part, changing the orientation of the metal part relative to a flow of the abrasive medium so as to expose additional surfaces on the metal part to the abrasive medium to alter the surface finish thereof.

9. The method of claim 1 wherein the treating includes blasting the surface with an abrasive medium from an array of nozzles oriented around the metal part so as to expose additional surfaces of the metal part to the abrasive medium to alter the surface finish thereof.

10. The method of claim 1 wherein the treating includes contacting the surface with an abrasive-coated device so as to alter the surface finish.

11. The method of claim 10 wherein the treating includes contacting the surface with an abrasive-coated device selected from the group consisting of: a grinding wheel, a wire wheel, a wire brush, and a sanding belt.

12. The method of claim 1 wherein the treating comprises coating the surface with a coating material so as to alter the surface finish.

13. The method of claim 12 wherein the coating material is a dry powder or liquid colloid.

14. The method of claim 1 wherein the measuring includes exposing the metal part to a device emitting electromagnetic radiation at a sufficient intensity to reflect the radiation to a respective electronic detection device, and wherein the respective detection device produces a signal used to determine the reflectivity of the surface at the point from which the radiation was reflected.

15. The method of claim 14 wherein the measuring further includes changing the orientation of the metal part in relation to the emitting and detection devices during the exposing to allow the radiation to be reflected from a plurality of points on the surface.

16. The method of claim 1 wherein the measuring includes exposing the metal part to an array of emitting devices oriented around the at least one metal part, each emitting electromagnetic radiation at a sufficient intensity to reflect the radiation to a respective detection device in an array of electronic detection devices, and wherein each respective detection device produces a signal used to determine the reflectivity of the surface at the point from which the radiation was reflected.

17. The method of claim 1 wherein the measuring includes contacting the surface at the one or more points with a stylus of a contact profilometer.

18. A method of preparing a batch of aluminum or aluminum alloy parts for heating by infrared radiance, the method comprising:

blasting the surfaces of a batch of two or more aluminum or aluminum alloy parts concurrently with an abrasive medium to alter the surface finish of each of the parts to affect the reflectivity of the surfaces throughout the batch; and measuring the reflectivity of the surfaces at a plurality of points in the batch including a point on each of at least two of the parts, the blasting and measuring being performed until the measuring indicates that a desired reflectivity is achieved at each of the plurality of points in the batch.

19. The method of claim 18 further comprising, after the desired reflectivity is achieved, exposing the batch of parts to infrared radiance to heat the parts to a desired temperature.

20. The method of claim 18 wherein the blasting includes one of blasting the surfaces with the abrasive medium while changing the orientation of the parts relative to a flow of the abrasive medium or blasting the surfaces with the abrasive medium from an array of nozzles oriented around the batch of parts so as to expose additional surfaces in the batch to the abrasive medium.

21. The method of claim 20 wherein the blasting includes accelerating the abrasive medium in a pressurized gas flow toward the surfaces.

22. The method of claim 20 wherein the blasting is shot blasting, sand blasting, grit blasting, glass bead blasting, or wet blasting.

23. The method of claim 18 wherein the measuring includes exposing the parts to a device emitting electromagnetic radiation at a sufficient intensity to reflect the radiation to a respective electronic detection device, and wherein the respective detection device produces a signal used to determine the reflectivity of the surface at the point from which the radiation was reflected.

24. The method of claim 23 wherein the measuring further includes changing the orientation of the parts in relation to the emitting and detection devices during the exposing to allow the radiation to be reflected from the plurality of points.

25. The method of claim 18 wherein the measuring includes exposing the parts to an array of emitting devices oriented around the batch of parts, each emitting electromagnetic radiation at a sufficient intensity to reflect the radiation to a respective detection device in an array of electronic detection devices, and wherein each respective detection device produces a signal used to determine the reflectivity of the surface at the point from which the radiation was reflected.

26. The method of claim 18 wherein the measuring includes contacting the surfaces at the plurality of points with a stylus of a contact profilometer.

27. A method of preparing and heating a batch of metal parts, the method comprising:

treating the surfaces of a batch of two or more metal parts concurrently with an abrasive medium to alter the surface finish of each of the parts to affect the reflectivity of the surfaces throughout the batch;

measuring the reflectivity of the surfaces at a plurality of points in the batch including a point on each of at least two of the parts, the treating and measuring being performed until the measuring indicates that a desired reflectivity is achieved at each of the plurality of points in the batch; and after the measuring indicates that the desired reflectivity is achieved, and without further treatment of the surfaces of the parts, heating the batch of metal parts having the achieved desired reflectivity with infrared radiance to a desired temperature.

28. The method of claim 27 wherein the metal parts comprise aluminum or an aluminum alloy.

29. The method of claim 28 wherein the treating includes one of blasting the surfaces with the abrasive medium while changing the orientation of the parts relative to a flow of the abrasive medium or blasting the surfaces with the abrasive medium from an array of nozzles oriented around the batch of parts so as to expose additional surfaces in the batch to the abrasive medium.

30. The method of claim 27 wherein the treating includes contacting the surfaces with an abrasive-coated device so as to alter the surface finish of the surfaces.

31. The method of claim 30 wherein the treating includes contacting the surfaces with an abrasive-coated device selected from the group consisting of: a grinding wheel, a wire wheel, a wire brush, and a sanding belt.

32. The method of claim 27 wherein the measuring includes exposing the parts to a device emitting electromagnetic radiation at a sufficient intensity to reflect the radiation to a respective electronic detection device, and wherein the respective detection device produces a signal used to determine the reflectivity of the surface at the point from which the radiation was reflected.

33. The method of claim 32 wherein the measuring further includes changing the orientation of the parts in relation to the emitting and detection devices during the exposing to allow the radiation to be reflected from the plurality of points.

34. The method of claim 27 wherein the measuring includes exposing the parts to an array of emitting devices oriented around the batch of parts, each emitting electromagnetic radiation at a sufficient intensity to reflect the radiation to a respective detection device in an array of electronic detection devices, and wherein each respective detection device produces a signal used to determine the reflectivity of the surface at the point from which the radiation was reflected.

35. The method of claim 27 wherein the measuring includes contacting the surfaces at the plurality of points with a stylus of a contact profilometer.

36. A method of preparing metal for heating by infrared radiance, the method comprising:

blasting the surface of a metal part with an abrasive medium to alter the surface finish to affect the reflectivity of the surface; and measuring the reflectivity of the surface at one or more points on the metal part by exposing the metal part to a device emitting electromagnetic radiation at a sufficient intensity to reflect the radiation to a respective electronic detection device, and wherein the respective detection device produces a signal used to determine the reflectivity of the surface at the point from which the radiation was reflected, the blasting and measuring being performed until the measuring indicates that a desired reflectivity is achieved.

37. The method of claim 36 wherein the metal part includes a threshold surface oriented to present a difficulty of alteration of the finish thereof that represents a maximum difficulty of alteration for the part, wherein the measuring includes a point on the threshold surface, and wherein the desired reflectivity is a minimum threshold reflectivity.

38. The method of claim 36 wherein the measuring is at a plurality of points and the blasting and measuring are performed until the measuring indicates that the desired reflectivity is achieved at each of the plurality of points.

39. The method of claim 36 wherein the blasting comprises blasting the surfaces of a batch of metal parts, the measuring is at a plurality of points taken from the surfaces of a plurality of metal parts in the batch, and the blasting and measuring are performed until the measuring indicates that the desired reflectivity is achieved at each of the plurality of points from the batch of metal parts.

40. The method of claim 36 wherein the metal part comprises aluminum or an aluminum alloy.

41. The method of claim 36 wherein the blasting includes accelerating the abrasive medium in a pressurized gas flow toward the surface.

42. The method of claim 36 wherein the blasting is shot blasting, sand blasting, grit blasting, glass bead blasting, or wet blasting.

43. The method of claim 36 further comprising, while blasting the part, changing the orientation of the metal part relative to a flow of the abrasive medium so as to expose additional surfaces on the metal part to the abrasive medium to alter the surface finish thereof.

44. The method of claim 36 wherein the blasting is from an array of nozzles oriented around the metal part so as to expose additional surfaces of the metal part to the abrasive medium to alter the surface finish thereof.

45. The method of claim 36 wherein the measuring further includes changing the orientation of the metal part in relation to the emitting and detection devices during the exposing to allow the radiation to be reflected from a plurality of points on the surface.

46. The method of claim 36 wherein the measuring includes exposing the metal part to an array of emitting devices oriented around the at least one metal part, each emitting electromagnetic radiation at a sufficient intensity to reflect the radiation to a respective detection device in an array of electronic detection devices, and wherein each respective detection device produces a signal used to determine the reflectivity of the surface at the point from which the radiation was reflected.

47. A method of preparing metal for heating by infrared radiance, the method comprising:

coating the surface of a metal part with a coating medium to alter the surface finish to affect the reflectivity of the surface; and physically measuring the reflectivity of the surface at one or more points on the metal part, the coating and measuring being performed until the measuring indicates that a desired reflectivity is achieved.

48. The method of claim 47 wherein the coating material is a dry powder or liquid colloid.

49. The method of claim 47 wherein the measuring is at a plurality of points and the treating and measuring are performed until the measuring indicates that the desired reflectivity is achieved at each of the plurality of points.

50. The method of claim 47 wherein the metal part includes a threshold surface oriented to present a difficulty of alteration of the finish thereof that represents a maximum difficulty of alteration for the part, wherein the measuring includes a point on the threshold surface, and wherein the desired reflectivity is a minimum threshold reflectivity.

51. The method of claim 47 wherein the treating comprises treating the surfaces of a batch of two or more metal parts concurrently, the measuring is at a plurality of points taken from the surfaces of a plurality of metal parts in the batch, and the treating and measuring are performed until the measuring indicates that the desired reflectivity is achieved at each of the plurality of points from the batch of metal parts.

52. The method of claim 47 wherein the metal part comprises aluminum or an aluminum alloy.

53. The method of claim 47 wherein the measuring includes exposing the metal part to a device emitting electromagnetic radiation at a sufficient intensity to reflect the radiation to a respective electronic detection device, and wherein the respective detection device produces a signal used to determine the reflectivity of the surface at the point from which the radiation was reflected.

54. The method of claim 53 wherein the measuring further includes changing the orientation of the metal part in relation to the emitting and detection devices during the exposing to allow the radiation to be reflected from a plurality of points on the surface.

55. The method of claim 47 wherein the measuring includes exposing the metal part to an array of emitting devices oriented around the at least one metal part, each emitting electromagnetic radiation at a sufficient intensity to reflect the radiation to a respective detection device in an array of electronic detection devices, and wherein each respective detection device produces a signal used to determine the reflectivity of the surface at the point from which the radiation was reflected.

56. The method of claim 47 wherein the measuring includes contacting the surface at the one or more points with a stylus of a contact profilometer.

* * * * *

UNITED STATES PATENT AND TRADEMARK OFFICE

CERTIFICATE OF CORRECTION

PATENT NO. : 7,544,256 B2
APPLICATION NO. : 10/892778
DATED : June 9, 2009
INVENTOR(S) : Howard Robinson Mayer and Craig A. Blue It is certified that error appears in the above-identified patent and that said Letters Patent is hereby corrected as shown below:

Col. 1, line 56, “affects” should read --effects--.

Col. 2, lines 34-35, “metal parts are changed” should read --metal parts is changed--.

Col. 2, line 42, “affect” should read --effect--.

Col. 7, line 61, “physically measuring the reflectivity of” should read --measuring the reflectivity of--.

Col. 7, line 62, “on the metal part,” should read --on the metal part using at least one measuring device,--.

Col. 8, line 50, “the measuring includes” should read --the measuring using at least one measuring device includes--.

Col. 8, line 57, “the measuring further includes” should read --the measuring using at least one measuring device further includes--.

Col. 8, line 62, “the measuring includes” should read --the measuring using at least one measuring device includes--.

Col. 9, line 4, “the measuring includes” should read --the measuring using at least one measuring device includes--.

Col. 11, line 48, “physically measuring the reflectivity of” should read --measuring the reflectivity of--.

Col. 11, line 49, “on the metal part,” should read --on the metal part using at least one measuring device,--.

Col. 12, lines 24-25, “the measuring includes” should read --the measuring using at least one measuring device includes--.

UNITED STATES PATENT AND TRADEMARK OFFICE

CERTIFICATE OF CORRECTION

PATENT NO. : 7,544,256 B2
APPLICATION NO. : 10/892778
DATED : June 9, 2009
INVENTOR(S) : Howard Robinson Mayer and Craig A. Blue It is certified that error appears in the above-identified patent and that said Letters Patent is hereby corrected as shown below:

Col. 12, lines 31-32, “the measuring further includes” should read --the measuring using at least one measuring device further includes--.

Col. 12, lines 36-37, “the measuring includes” should read --the measuring using at least one measuring device includes--.

Col. 12, lines 45-46, “the measuring includes” should read --the measuring using at least one measuring device includes--.

Signed and Sealed this

Twenty-eighth Day of July, 2009

John Doll

JOHN DOLL
*Acting Director of the United States Patent and Trademark Office*